US008125505B2

(12) United States Patent
Takeda

(10) Patent No.: US 8,125,505 B2
(45) Date of Patent: Feb. 28, 2012

(54) IMAGE FORMING APPARATUS THAT CORRECTS CLOCK PHASE DIFFERENCE

(75) Inventor: Shoji Takeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 12/844,667

(22) Filed: Jul. 27, 2010

(65) Prior Publication Data

US 2011/0025812 A1 Feb. 3, 2011

(30) Foreign Application Priority Data

Jul. 31, 2009 (JP) ..... 2009-178983

(51) Int. Cl.
*B41J 2/435* (2006.01)
*B41J 2/47* (2006.01)

(52) U.S. Cl. ..... 347/235; 347/249; 347/250

(58) Field of Classification Search ..... 347/229, 347/234–236, 247–250
See application file for complete search history.

(56) References Cited

U.S. PATENT DOCUMENTS 5,122,883 A * 6/1992 Carley ..... 358/296
5,982,408 A * 11/1999 Overall et al. ..... 347/250
6,590,461 B2 * 7/2003 Kawano ..... 331/74
7,224,378 B2 * 5/2007 Maeda ..... 347/235
2009/0141317 A1 * 6/2009 Takeda ..... 358/475

FOREIGN PATENT DOCUMENTS

JP 2003-322810 11/2003

* cited by examiner

*Primary Examiner* — Hai C Pham

(74) *Attorney, Agent, or Firm* — Fitzpatrick, Cella, Harper & Scinto

(57) ABSTRACT

An image forming apparatus capable of forming a high-resolution image without complicating a circuit construction. A difference between a phase of an operation clock for a BD detection unit and a phase of an operation clock for an image processing unit is measured by a phase measurement unit of the image forming apparatus, and a timing of data delivery between the BD detection unit and the image processing unit is adjusted by a BD input timing adjuster based on a measurement result. A difference between the phase of the operation clock for the image processing unit and a phase of an operation clock for a laser drive unit is measured by the phase measurement unit, and a timing of data delivery between the image processing unit and the laser drive unit is adjusted by an image output timing adjuster based on a measurement result.

6 Claims, 11 Drawing Sheets

*FIG.9A*

| bit | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| | 0 | 1 | 1 | 1 | 1 | 1 | 1 | 1 | 0 | 0 | 0 | 0 | 0 | 0 | 0 | 1 |

*FIG.9B*

| bit | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| | 0 | 0 | 0 | 0 | 0 | 0 | 0 | 1 | 1 | 1 | 1 | 1 | 1 | 1 | 1 | 0 |

IMAGE FORMING APPARATUS THAT CORRECTS CLOCK PHASE DIFFERENCE

BACKGROUND OF THE INVENTION

1. Field of the Invention

The present invention relates to an image forming apparatus such as a laser printer or a digital copying machine for forming an image by subjecting a photosensitive member to an electrographic process including charging, exposure, and development.

2. Description of the Related Art

An electrophotographic image forming apparatus includes a charging unit, a laser scanning unit, a developing unit, and a transfer unit, which are for subjecting a photosensitive member of the apparatus to an electrophotographic process. The charging unit uniformly charges a photosensitive surface of the photosensitive member. The laser scanning unit includes a light source and emits laser light according to image data input from an external information unit such as an original reading unit or a computer. The emitted laser light is scanned by a deflection unit (polygon mirror). The scanned laser light is guided through lenses and reflection mirrors to and scanned on the charged photosensitive surface of the photosensitive member. When the photosensitive member is scanned by the laser light, an electrostatic latent image is formed on the photosensitive member. Subsequently, the latent image is developed by the developing unit and transferred by the transfer unit onto a recording sheet.

The laser scanning unit includes a detection device for detecting the laser light scanned by the polygon mirror. The detection device detects the laser light at each scanning of the laser light, and outputs an image-formation start timing signal when detecting the laser light. Based on the image-formation start timing signal and image data, the laser scanning unit outputs the laser light according to an image clock that varies according to image resolution. By emitting the laser light based on the image-formation start timing signal, it is possible to align positions on the photosensitive member where electrostatic latent image portions are formed by respective scannings.

When the temperature and humidity vary in the image forming apparatus, changes occur in positions where component parts (such as the lenses and the reflection mirrors) are installed in the laser scanning unit, causing a change in the position on the photosensitive surface where the electrostatic latent image is formed. The position of the latent image being formed also varies according to the machining accuracy of the component parts of the unit. If the latent image is formed not at a predetermined position, the position on a recording medium where an image is formed is deviated from the desired position. In the case of a color image forming apparatus, scanning lines for respective colors which are to be superimposed on one another are deviated from one another, resulting in degraded image quality.

To obviate this, it is known, as proposed in Japanese Laid-open Patent Publication No. 2003-322810, to adjust the position of a latent image being formed by shifting a pixel clock based on pixel clock phase.

With the proposed technique, however, a plurality of clock generation circuits are provided in order to generate pixel clocks, and therefore the resultant circuit construction becomes complicated. To simplify the circuit construction, it may be possible to adopt a method for performing operations from processing on a laser light detection signal to driving of a laser scanning unit based on a reference clock output from a single oscillator. In that case, however, differences are produced between phases of the reference clock input to respective units due to, e.g., differences between transmission line lengths from the oscillator to the units. The phase differences cause a shift in image writing start position.

SUMMARY OF THE INVENTION

The present invention provides an image forming apparatus capable of correcting a difference between phases of a reference clock due to, e.g., differences between lengths of transmission lines from an oscillator to respective units of the image forming apparatus, thereby controlling an image writing start position with high accuracy.

According to the present invention, there is provided an image forming apparatus in which light beams emitted from respective ones of light-emitting elements are scanned on an image carrier by a deflection scanning unit to thereby form an electrostatic latent image on the image carrier, comprising a sensor configured to detect any of the light beams deflected by the deflection scanning unit and output a detection signal, an oscillation unit configured to generate a reference clock, a detection unit configured to convert the detection signal into parallel data according to a first sub-clock obtained by multiplying the reference clock by N, and output the parallel data in synchronism with a clock obtained by dividing the first sub-clock by N, an image processing unit configured to operate based on the reference clock and output input image data in synchronism with the reference clock, a laser drive unit configured to receive the image data from the image processing unit in synchronism with a clock obtained by dividing, by M, a second sub-clock obtained by multiplying the reference clock by M and configured to drive the light-emitting elements based on serial data obtained by converting the received image data according to the second sub-clock, a first adjustment unit configured to adjust a timing of data delivery from the detection unit to the image processing unit based on a difference between a phase of the clock obtained by dividing the first sub-clock by N and a phase of the reference clock supplied to the image processing unit, and a second adjustment unit configured to adjust a timing of data delivery from the image processing unit to the laser drive unit based on a difference between the phase of the reference clock supplied to the image processing unit and a phase of the clock obtained by dividing the second sub-clock by M.

With the image forming apparatus of this invention, it is possible to control an image writing start position with high accuracy without complicating a circuit construction, even if there is a difference between the phase of operation clock for a data output side unit and the phase of operation clock for a data input side unit.

Further features of the present invention will become apparent from the following description of an exemplary embodiment with reference to the attached drawings.

BRIEF DESCRIPTION OF THE DRAWINGS

FIGS. 9A and 9B show examples of data representing results of clock phase measurements;

DETAILED DESCRIPTION OF THE PREFERRED EMBODIMENT

The present invention will now be described in detail below with reference to the drawings showing a preferred embodiment thereof.

Figure 1:
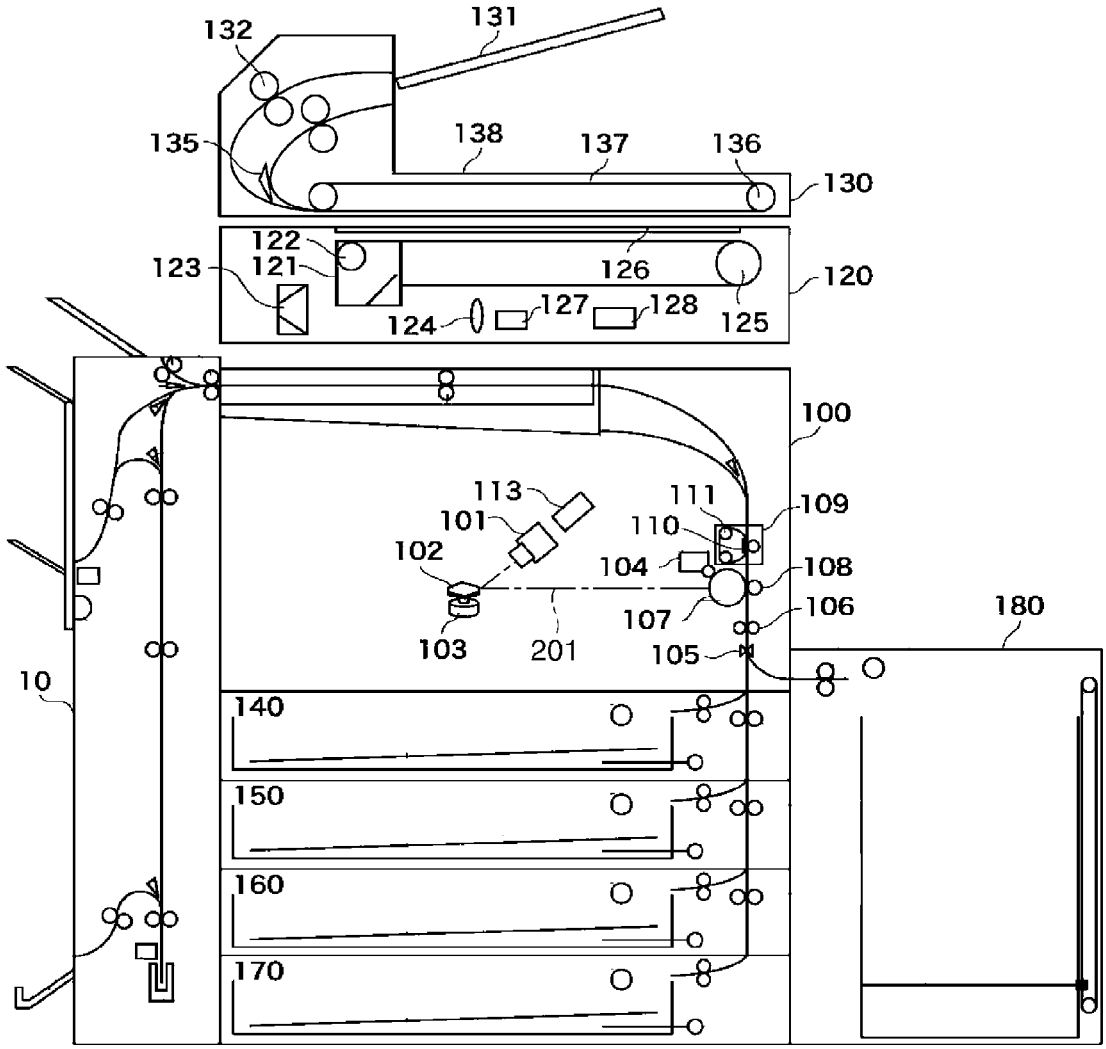
FIG. 1 is a view showing the construction of a digital multi-function peripheral as an image forming apparatus according to one embodiment of this invention.

FIG. 1 shows the construction of a digital multi-function peripheral as an electrophotographic image forming apparatus according to one embodiment of this invention.

First, a description will be given of an original conveyance unit 130 and an original reading unit 120 that constitute an image reading apparatus of the digital multi-function peripheral. Originals set on an original placement table 131 are conveyed one by one by a sheet feed roller 132. An original conveyance belt 137 driven by a motor 136 conveys each original to an original reading position where the original is read by the original reading unit 120. Subsequently, a conveyance path is changed by a flapper 135, and the original is discharged to a sheet discharge tray 138 by reversely rotating the motor 136.

An exposure lamp 122 consisting of, e.g., a fluorescent lamp or a halogen lamp irradiates light onto an original placed on an original placement glass (original table) 126 while being moved along the original table 126. Scattered light from the original is reflected by first and second mirror tables 121, 123 and then reaches a lens 124. When the first mirror table 121 is moved, the second mirror table 123 is moved at a speed half of a moving speed of the first mirror table 121, so that a distance between the original surface and the lens 124 is kept constant. The mirror tables 121, 123 are moved by a motor 125. An image of the original is formed on a light-receiving portion of a CCD line sensor 127 having several thousands of light-receiving elements arranged in a line, via the mirror tables 121, 123 and the lens 124, and is photoelectrically converted into a detection signal on a per line basis. The detection signal is processed by a signal processing unit 128 and output as an image signal from the unit 128.

Next, a description will be given of the construction and operation of an image forming unit 100 of the digital multi-function peripheral. An exposure controller of the image forming unit 100 causes an image processing unit 113 to perform processing according to the characteristic of electrophotography and based on the image signal output from the signal processing unit 128. The exposure controller drives a semiconductor laser 101 (light source) based on the image signal (input image data) to cause the semiconductor laser 101 to emit laser light 201. The laser light 201 is scan-deflected by a polygon mirror 102 (rotary polygonal mirror) as a deflection scanning unit, and is scanned on a photosensitive member 107 (image carrier) rotated about its rotary shaft at a constant speed. It should be noted that before the laser light 201 is irradiated onto the photosensitive member 107, residual electric charges remaining on a surface of the photosensitive member 107 are removed by an pre-exposure lamp (not shown) and the surface of the photosensitive member 107 is uniformly charged by a primary charging device (not shown). An electrostatic latent image is formed on the photosensitive member 107 which is irradiated with the laser light 201 while being rotated. The latent image is developed and visualized by a developing device 104 with a developer (toner) of a predetermined color.

A transfer sheet is fed from any of sheet feed cassettes 140, 150, 160, 170, 180 and transferred to a registration roller 106. The arrival of the transfer sheet to the registration roller 106 is detected by a sensor 105, and a sheet feed timing is adjusted at the registration roller 106 such that the image formed on the photosensitive member 107 is transferred to a predetermined position on the transfer sheet. It should be noted that the construction and function of the sheet feed cassettes 140-170 disposed in a main body of the multi-function peripheral and the construction and function of the sheet feed cassette deck 180 capable of storing a large volume of transfer sheets are known, and therefore a description thereof is omitted.

A transfer charging device 108 transfers the toner image formed on the photosensitive member 107 to a transfer sheet. Subsequently, residual toner remaining on the photosensitive member 107 is removed by a cleaner (not shown). Since the photosensitive member 107 has a large radius of curvature, the transfer sheet can easily be separated from the photosensitive member 107. Nevertheless, to further ease the separation of the transfer sheet from the photosensitive member 107, a voltage is applied to a discharging needle (not shown) to reduce an attraction force acting between the photosensitive member 107 and the transfer sheet.

The transfer sheet separated from the photosensitive member 107 is conveyed to a fixing device 109 where the toner image is fixed onto the transfer sheet. The fixing device 109 includes a ceramic heater 110, a film 111, and three rollers. Heat of the ceramic heater 110 is efficiently conveyed to the transfer sheet via the film 111, which is thin, whereby the toner image is fixed to the transfer sheet. Then, the transfer sheet is discharged to the outside of the multi-function peripheral, e.g., to an after-treatment apparatus 10. Since the construction and function of the after-treatment apparatus 10 is known, a description thereof is omitted.

Figure 2:
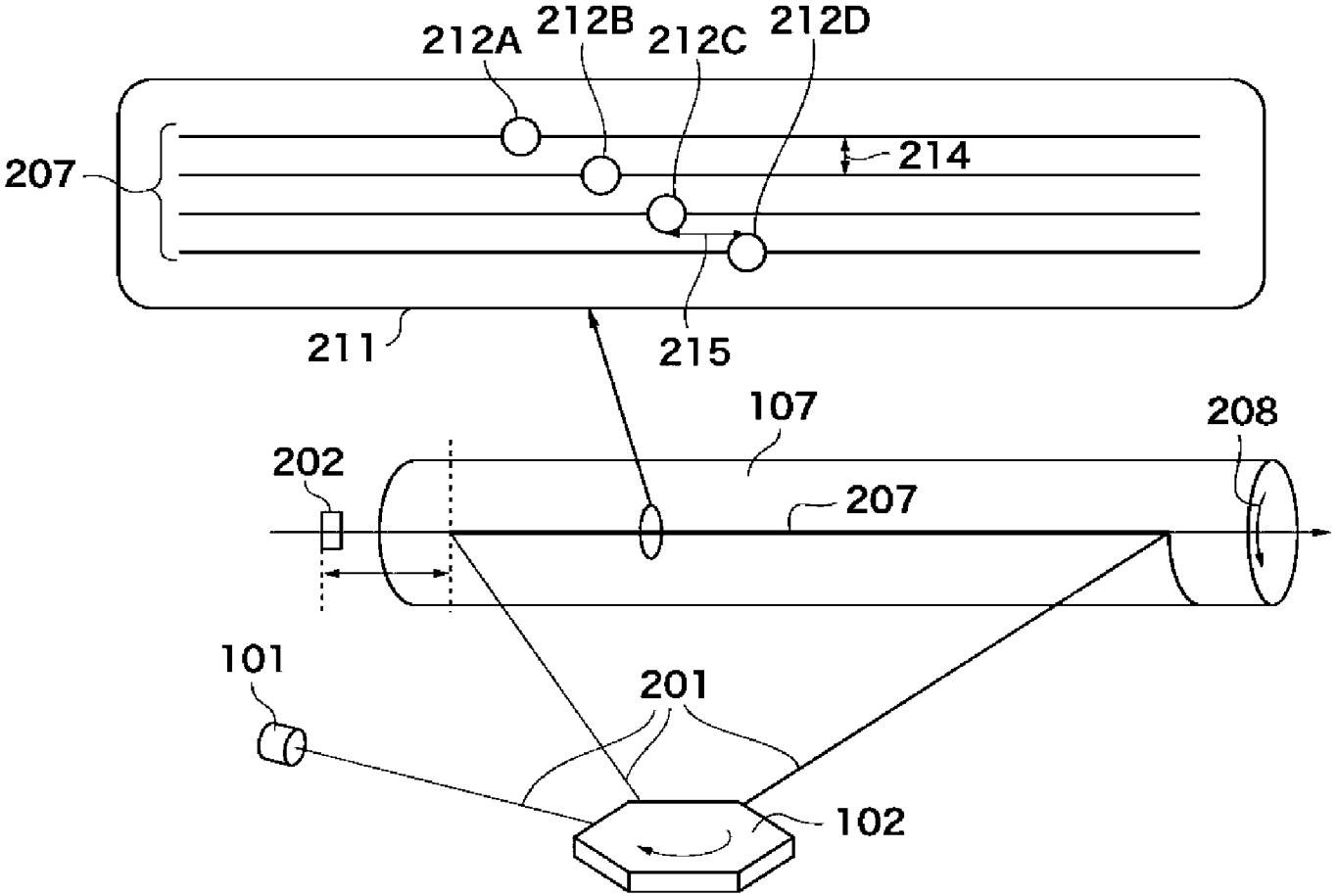
FIG. 2 is a schematic view showing a laser light scanning unit of an image forming unit of the digital multi-function peripheral.

FIG. 2 schematically shows a laser light scanning unit of the image forming unit 100. The scanning unit includes the semiconductor laser 101 as a light source, the polygon mirror 102 as a deflection scanning unit, a drive motor (shown at 103 in FIG. 1) for rotatably driving the polygon mirror 102, and a beam detection sensor (hereinafter, referred to as the BD sensor) 202 that serves as a detection unit.

The semiconductor laser of the image forming unit 100 includes a plurality of light-emitting elements. The semiconductor laser 101 of the image forming unit 100 of this embodiment includes four light-emitting elements that emit four laser beams 201 (shown by one line in FIG. 2) according to image data output from the image processing unit 113. These laser beams 201 are reflected by the same is reflection surface of the rotating polygon mirror 102 so that four scanning lines 207 are formed on the photosensitive member 107 (see, a photosensitive member portion 211, which is shown in enlarged scale at upper part of FIG. 2). Thus, the four scanning lines 207 are simultaneously formed on the photosensitive member 107 by one scanning.

In FIG. 2, reference numeral 214 denotes a distance between adjacent scanning lines 207 as viewed in the sub-scanning direction. The distance 214 is, e.g., about 21 μm (1200 DPI). A positional relation between the semiconductor laser 101, the polygon mirror 102, and the photosensitive member 107 and an arrangement of the four light-emitting elements in the semiconductor laser 101 are decided such as to form the just-mentioned scanning lines 207 on the photosensitive member 107, whereby an electrostatic latent image can be formed on the photosensitive member 107 with high resolution. In the following, the four light-emitting elements of the semiconductor laser 101 will be referred to as the first through fourth lasers and denoted by the same reference numeral 100 with different suffixes A to D (not shown in the drawings for simplicity of illustration).

In FIG. 2, reference numerals 212A to 212D denote beam spots formed on the photosensitive member 107 by the four laser beams in a case where these laser beams are emitted at the same timing from the first through fourth lasers 101A to 101D. Reference numeral 215 denotes a distance between beam spots which are adjacent to each other in the main scanning direction.

In the example shown in FIG. 2, the beam spot 212D precedes the beam spot 2120, the beam spot 212C precedes the beam spot 212B, and the beam spot 212B precedes the beam spot 212A, as seen in the main scanning direction. If therefore the laser beams are emitted at the same timing from respective ones of the first through fourth lasers 101A to 101D, the laser spots 212A to 212D have different positions in the main scanning direction so that the image output position on the photosensitive member 107 becomes different between the four laser beams. To make the image output position coincide between the laser beams, output timings of drive signals for the second to fourth lasers 101B to 101D are each delayed from an output timing of a drive signal for the first laser 101A by one or two or three multiples of the beam spot distance 215.

To this end, a beam detection signal (BD signal) as a reference laser drive signal is generated, e.g., when the laser beam emitted from the first laser 101A passes across the BD sensor 202 located on an extension line of the scanning lines formed on the photosensitive member 107. Upon elapse of a predetermined time period after the BD signal is generated, the first laser 101A is started to be driven. Subsequently, upon respective elapses of time periods each corresponding to one or two or three multiples of the beam spot distance 215, the second through fourth lasers 101B-101D are sequentially started to be driven, whereby the positions where electrostatic latent image portions are formed by respective ones of the four laser beams are made coincident with one another. Until start of the beam scanning with the next polygon surface, the photosensitive member 107 is rotated in a direction shown by arrow 208 for a distance which is four times the scanning line distance 214. By repeating the beam scanning, a two-dimensional electrostatic latent image is formed on the photosensitive member 107.

In the image forming apparatus (multi-function peripheral) of this embodiment, operations from laser beam detection to laser driving are performed according to a reference clock signal output from a single oscillator (oscillation unit), whereby driving circuits for various units of a laser writing control system of the image forming apparatus can be simplified. However, a difference is produced between the phase of operation clock for a data output side unit and that for a data input side unit due to, e.g., a difference between transmission line lengths, resulting in a shift of image writing start position. To obviate this, the multi-function peripheral of this embodiment is configured to be able to control the image writing start position with high accuracy, even if a difference is produced between the phases of operation clock for various units. In the following, a construction therefor will be described.

Figure 3:
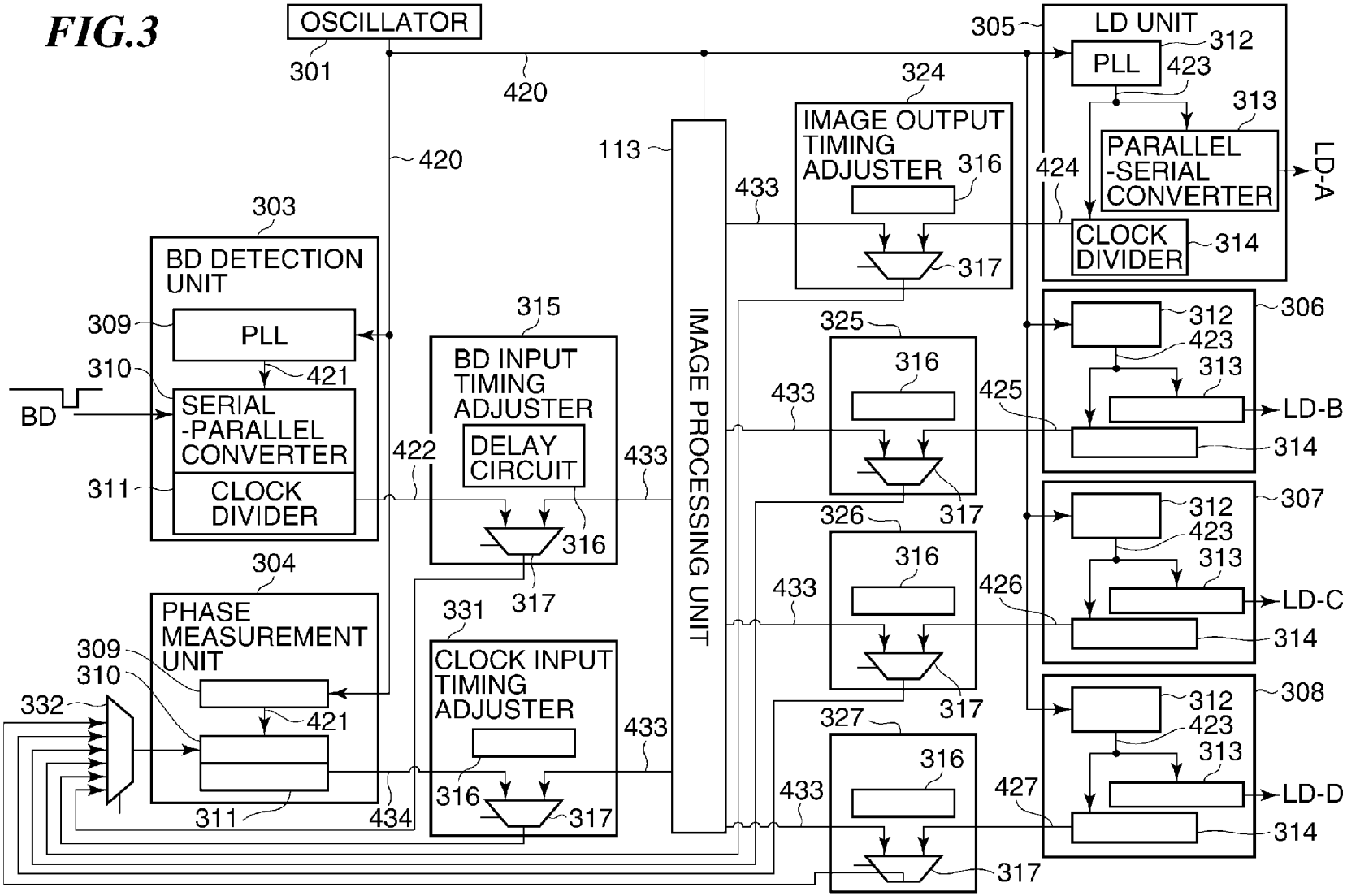
FIG. 3 is a block diagram showing a laser writing control system of the digital multi-function peripheral.
Figure 4:
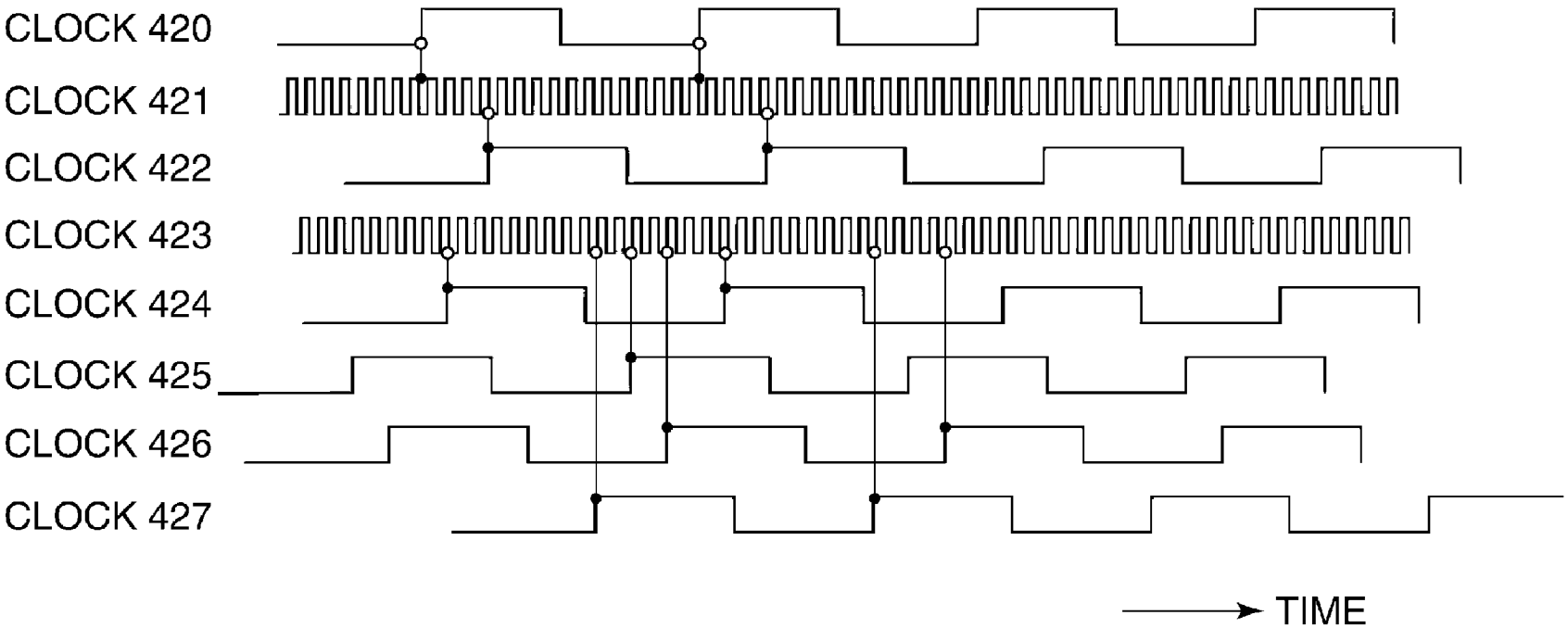
FIG. 4 is a view showing clock signals input to various parts of the laser writing control system.

FIG. 3 shows in block diagram the laser writing control system of the digital multi-function peripheral for performing operations from laser beam detection to laser driving, and FIG. 4 shows clock signals input to various units of the laser writing control system.

As shown in FIG. 3, the laser writing control system includes an oscillator 301 for generating a reference clock 420 of, e.g., 231.75 MHz. The reference clock 420 is supplied from the oscillator 301 to a BD detection unit 303 (corresponding to the BD sensor 202), a phase measurement unit 304, laser drive units (hereinafter, referred to as the LD units) 305 to 308, and the image processing unit 113 via, e.g., LVDS (low voltage differential signaling) transmission paths (wirings).

The image processing unit 113 operates on the reference clock 420, divides raster image data into data segments of M bits (e.g., 16 bits), and outputs the data segments to image output timing adjusters 324-327 via data lines (not shown) at intervals of a clock period. Each of the timing adjusters 324-327 includes a delay circuit 316 that delays an image data output timing, and outputs the image data to a corresponding one of the LD units 305-308 at the delayed timing.

The BD detection unit 303 includes a phase-locked loop circuit (PLL) 309, a serial-parallel converter 310, and a clock divider 311.

The PLL 309 (first sub-clock generator unit) multiplies the reference clock 420 of 231.25 MHz by N (e.g., by 16), thereby generating a sub-clock 421 of 3.7 GHz (first sub-clock signal). The serial-parallel converter 310 (first conversion unit) samples, according to the sub-clock 421, a BD signal (serial signal) generated by the BD sensor 202, and converts the sampled BD signal into a 16-bit BD signal (parallel data). The clock divider 311 (first clock divider unit) divides by N (e.g., by 16) the clock 421 supplied from the PLL 309, thereby generating a clock 422 of 231.25 MHz.

The BD detection unit 303 outputs the 16-bit BD signal (parallel data) generated by the serial-parallel converter 310 to a BD input timing adjuster 315 according to the clock 422 generated by the clock divider 311.

The PLL 309 oscillates at the oscillation frequency of 3.7 GHz, so that the working speed of the serial-parallel converter 310 reaches a critical limit. It is therefore difficult for the serial-parallel converter 310 to be configured to include a circuit for starting serial-parallel conversion (i.e., generation of parallel data from the serial signal (BD signal)) in synchronism in timing with the input reference clock 420. On the other hand, the BD signal (parallel data) is transmitted to the image processing unit 113 via a transmission line of several tens centimeters length, and there is a shift in the phase of the reference clock 420 (which originally serves as synchronization clock) between when the reference clock 420 arrives at the image processing unit 113 via the BD detection unit 303 and when it directly arrives at the image processing unit 113. Thus, the BD input timing adjuster 315 is provided for phase adjustment of the reference clock 420 according to transmission path length (i.e., for adjustment of the phase of the reference clock supplied via the BD detection unit 303 and the phase of the reference clock supplied not via the BD detection unit 303).

Further, the clock 422 synchronous with the BD signal (parallel data) is generated by the clock divider 311 in the laser writing control system of this embodiment. With such construction, it is unnecessary to provide the serial-parallel converter 310 with a circuit for starting the serial-parallel conversion of BD signal in synchronism with the reference clock 420. Thus, a circuit in the serial-parallel converter 310, which is to be operated at high frequency, can be simplified. As shown in FIG. 4, the clock 420 and the clock 422 are the same in frequency as each other but different in phase from each other. The phase relation between these clocks changes at each power on.

The LD unit 305 of the laser writing control system includes a PLL 312 (second sub-clock generator unit), a parallel-serial converter 313 (second conversion unit), and a clock divider 314 (second clock divider unit).

As with the PLL 309, the PLL 312 multiplies the clock 420 of 231.25 MHz by 16 (more generally, by M), thereby generating a clock 423 of 3.7 GHz (second sub-clock signal). The parallel-serial converter 313 receives image data (parallel data) from the image processing unit 113 via a data line (not shown), converts the image data into a laser drive signal LD-A (serial data) according to the clock 423, and outputs the signal LD-A to the first laser 101A. The clock divider 314 divides the clock 423 by 16 (more generally, by M) to thereby generate a clock 424, and supplies the frequency-divided clock 424 to the image output timing adjuster 324.

As with the BD detection unit 303, it is difficult for the laser drive unit 305 to be configured to include a circuit for starting serial-parallel conversion of laser drive data in synchronism in timing with the input reference clock 420. On the other hand, the laser drive data is transmitted from the image processing unit 113 to the LD unit 305 via a transmission line of several tens centimeters length, and there is a shift in the phase of the reference clock 420 between when the reference clock 420 directly arrives at the LD unit 305 and when the reference clock 420 arrives at the LD unit 305 via the image processing unit 113. Thus, an image output timing adjuster 324 is provided for phase adjustment of data (synchronous with the reference clock 420) according to transmission path length, and the clock 424 synchronous with an LD data reception timing is generated by the clock divider 314, whereby the parallel-serial converter 313 can be simplified by eliminating a circuit for starting the parallel-serial conversion of the LD data in synchronism with the reference clock 420.

As described above, the LD unit 305 parallel-serial converts image data (parallel data) into the laser drive signal LD-A according to the clock 423 (which is obtained by multiplying the clock 420 by 16), and outputs the signal LD-A to the first laser 101A. The LD unit 305 supplies the image output timing adjuster 324 with the clock 424, which is obtained by dividing the clock 423 by 16.

The LD units 306-308 each having the same construction as the LD 305 output laser drive signals LD-B to LD-D to respective ones of the second to fourth lasers 101B-101D, and supply clocks 425-427 obtained by dividing the clock 423 by 16 to respective ones of image output timing adjusters 325-327. The clocks 424-427 are the same in frequency as one another but different in phase from one another. The phase relation between the clocks 424-427 changes at each power on.

BD detection data (16-bit BD sampling data) is transferred from the BD detection unit 303 to the image processing unit 113 according to the clock 422. The transfer clock 422 differs in phase from the operation clock 420 for the image processing unit 113, and such phase difference produces a fear that the image writing start timing is shifted. Thus, the BD input timing adjuster 315 for detecting a phase difference between the transfer clock 422 and the reference clock 420 is provided in the image forming apparatus of this embodiment. The BD input timing adjuster 315 functions as a first adjustment unit for adjusting a timing of BD sampling data delivery from the BD detection unit 303 to the image processing unit 113.

The BD input timing adjuster 315 includes a delay circuit 316 for shifting BD data by an arbitrary number of bits (one or more bits) and sending the bit-shifted data to the image processing unit 113.

Figure 5:
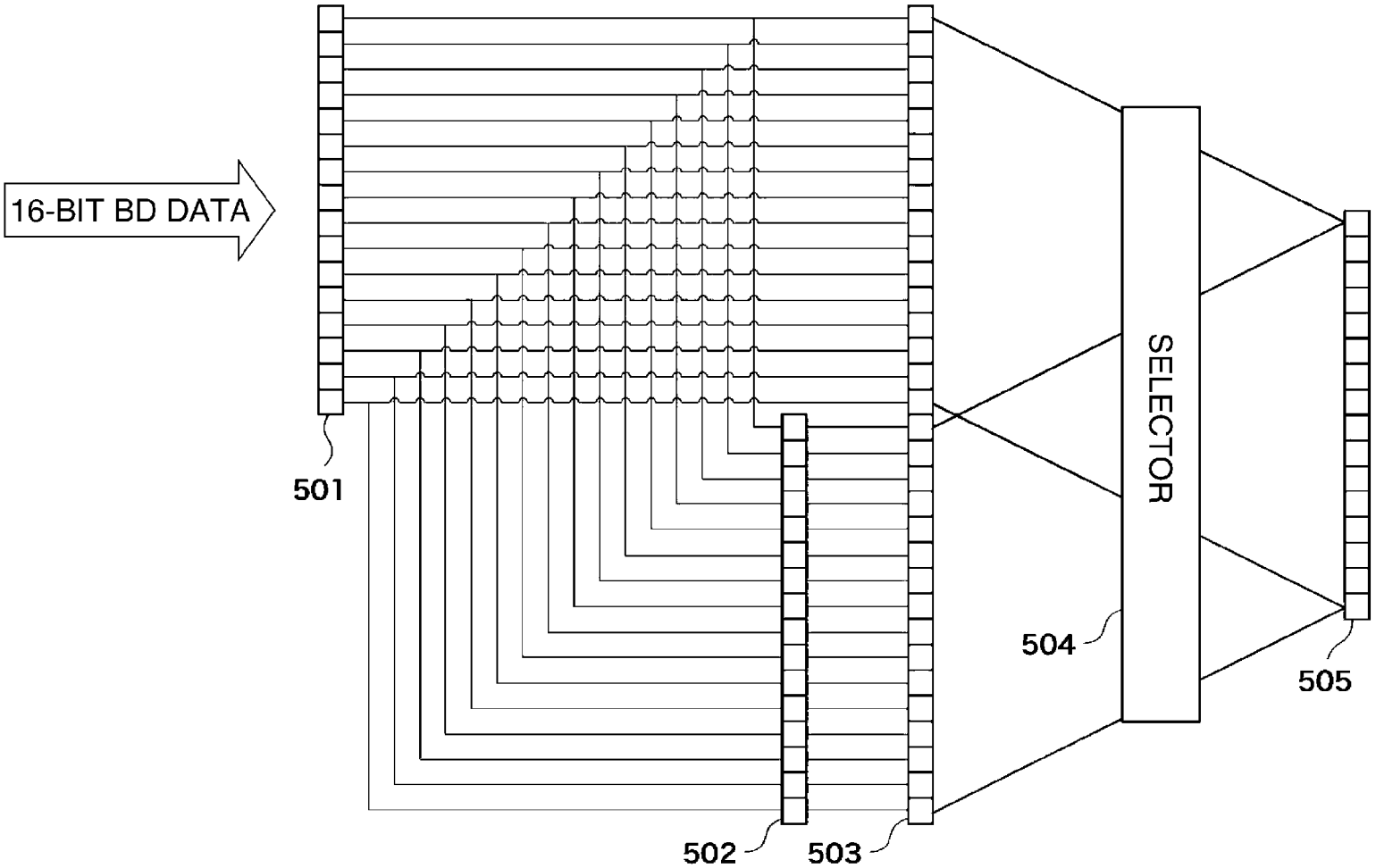
FIG. 5 is a schematic view showing the construction of a delay circuit of a BD input timing adjuster in the laser writing control system.

FIG. 5 shows the construction of the delay circuit 316 of the BD input timing adjuster 315. As shown in FIG. 5, the delay circuit 316 includes a flip-flop 501 that receives BD sampling data (parallel data generated from the BD signal by the serial-parallel conversion unit 310 of the BD detection unit 303). The flip-flop 501 is able to store x-bit data (here, 16-bit data) corresponding to the BD sampling data and connected to a flip-flop 502 which is able to store 16-bit BD sampling data. Thus, y-bit (here, 32-bit) BD sampling data can be stored in these flip-flops 501 and 502.

The 16-bit BD sampling data input to the flip-flop 501 is transferred to the flip-flop 502, and new 16-bit BD sampling data is input to the flip-flop 501. The 16-bit data stored in the flip-flop 501 and the 16-bit data stored in the flip-flop 502 are transferred to the flip-flop 503, whereby an alignment of BD sampling data of 32 bits in total is attained. From among the 32-bit BD sampling data, a selector 504 selects aligned 16-bit continuous data starting from a bit position counted from the first bit of the 32-bit data and decided according to a phase difference between the clock 420 input to the BD detection unit 303 and the clock 420 input to the image processing unit 113. Then, the selector 504 outputs the selected 16-bit data to an output-stage flip-flop 505.

As with the BD input timing adjuster 315, the image output timing adjusters 324-327 each include a delay circuit 316. The image output timing adjuster 324 has the same construction as the timing adjuster 315 and sends image data input from the image processing unit 113 to the LD unit 305. At that time, the delay circuit 316 of the timing adjuster 324 outputs aligned 16-bit continuous data starting from a bit position decided according to a phase difference between the clock 420 input to the image processing unit 113 and the clock 420 input to the LD unit 305.

In the semiconductor laser 101 of the laser light scanning unit shown in FIG. 2, the distance between adjacent ones of the first to fourth lasers 101A to 101D (light-emitting elements) is not uniform in a strict sense, so that image writing start positions by the lasers 101A to 101D are not exactly coincident with one another. To exactly align the writing start positions, it is necessary to adjust timings of data delivery from the image processing unit 113 to respective ones of the LD units 305-308. Thus, the image output timing adjusters 324-327 are provided, each of which functions as a second adjustment unit for adjusting the timing of data delivery from the image processing unit 113 to a corresponding one of the LD units 305-308, whereby the writing start positions by the lasers 101A to 101D can be aligned in the main scanning direction.

As previously described, the BD input timing adjuster 315 selects aligned 16-bit data according to a difference between the phase of operation clock for the BD detection unit 303 and the phase of operation clock for the image processing unit 113. Similarly, each of the image output timing adjusters 324-327 selects aligned 16-bit data according to a difference between the phase of operation clock for the image processing unit 113 and the phase of operation clock for a corresponding one of the LD units 305-308.

The laser writing control system includes a phase measurement unit 304 for measuring clock phase differences. As with the BD detection unit 303, the phase measurement unit 304 includes a PLL circuit 309, a serial-parallel converter 310, and a clock divider 311.

The phase measurement unit 304 is able to selectively input an arbitrary clock via any of clock selectors 317 of the BD input timing adjuster 315, the image output timing adjusters 324-327, and a clock input timing adjuster 331 and via a input selector 332.

Figure 6:
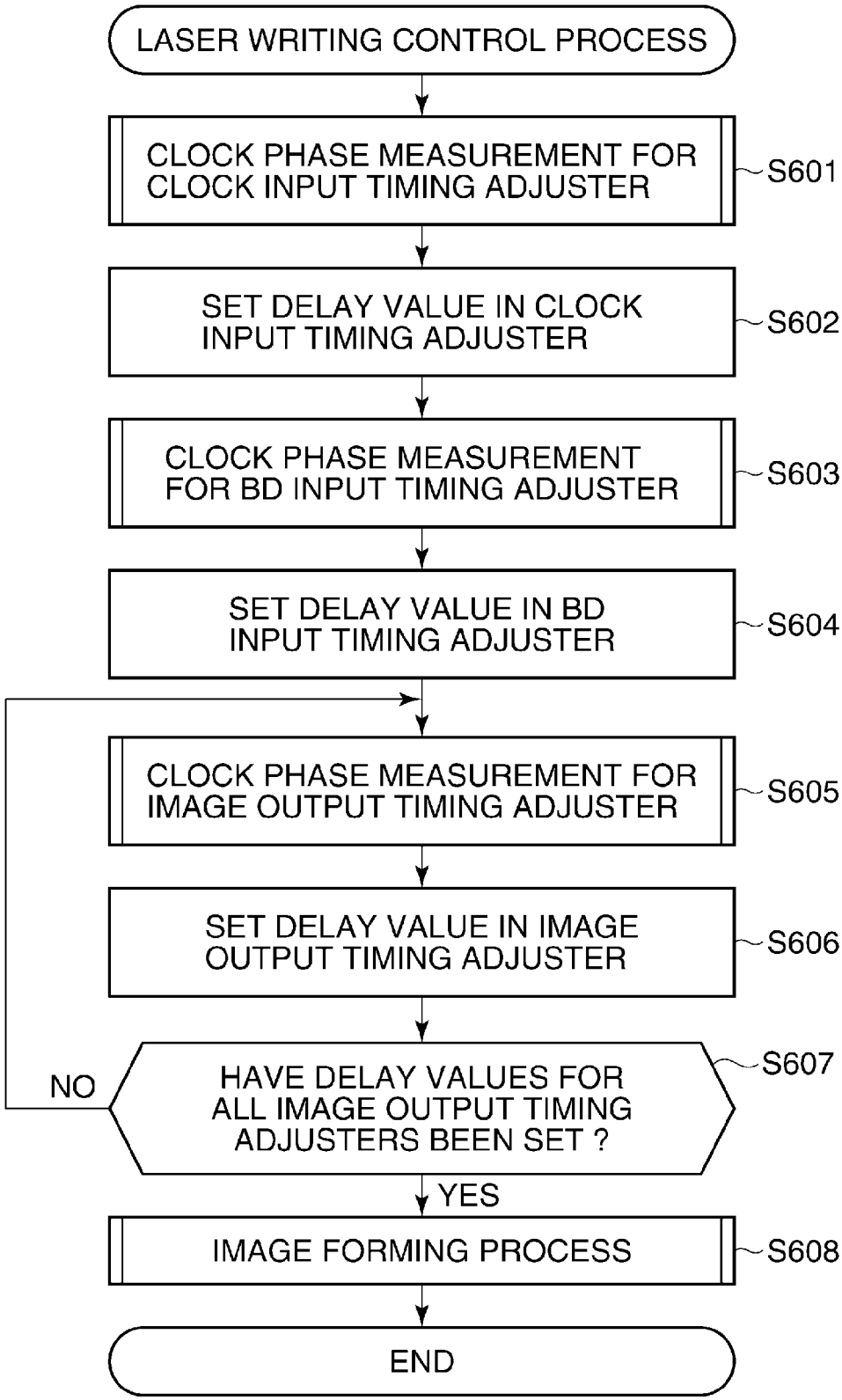
FIG. 6 is a flowchart showing the procedures of laser writing control performed by the laser writing control system.
Figure 7:
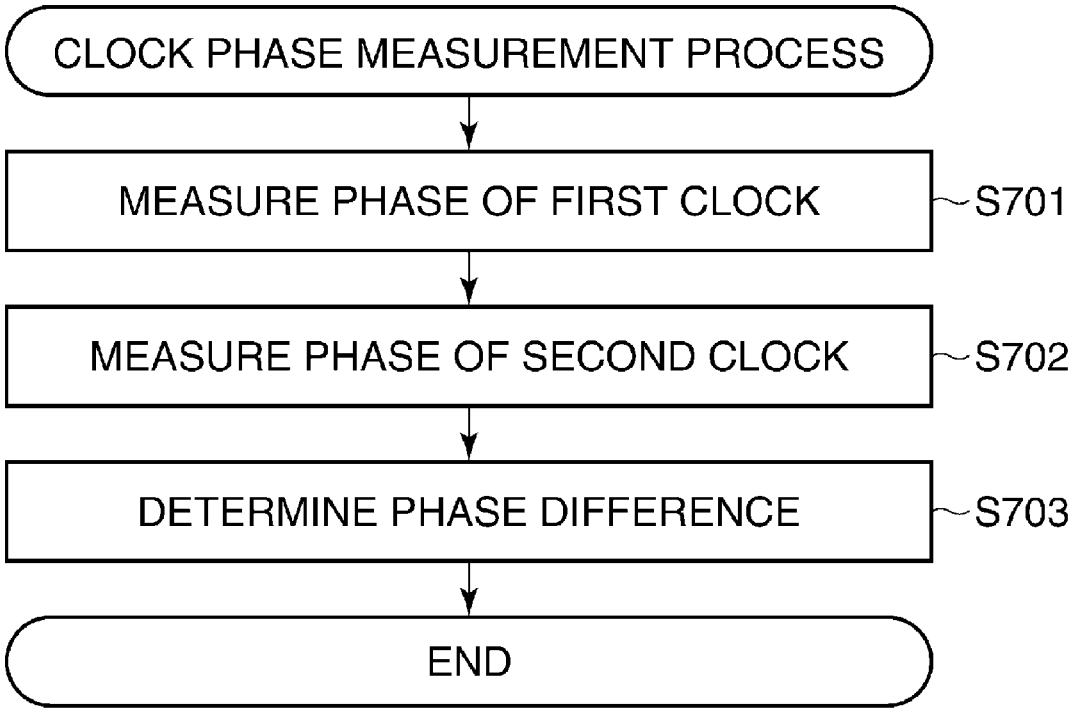
FIG. 7 is a flowchart showing the procedures of a clock phase measurement process performed in S601 in FIG. 6.
Figure 8:
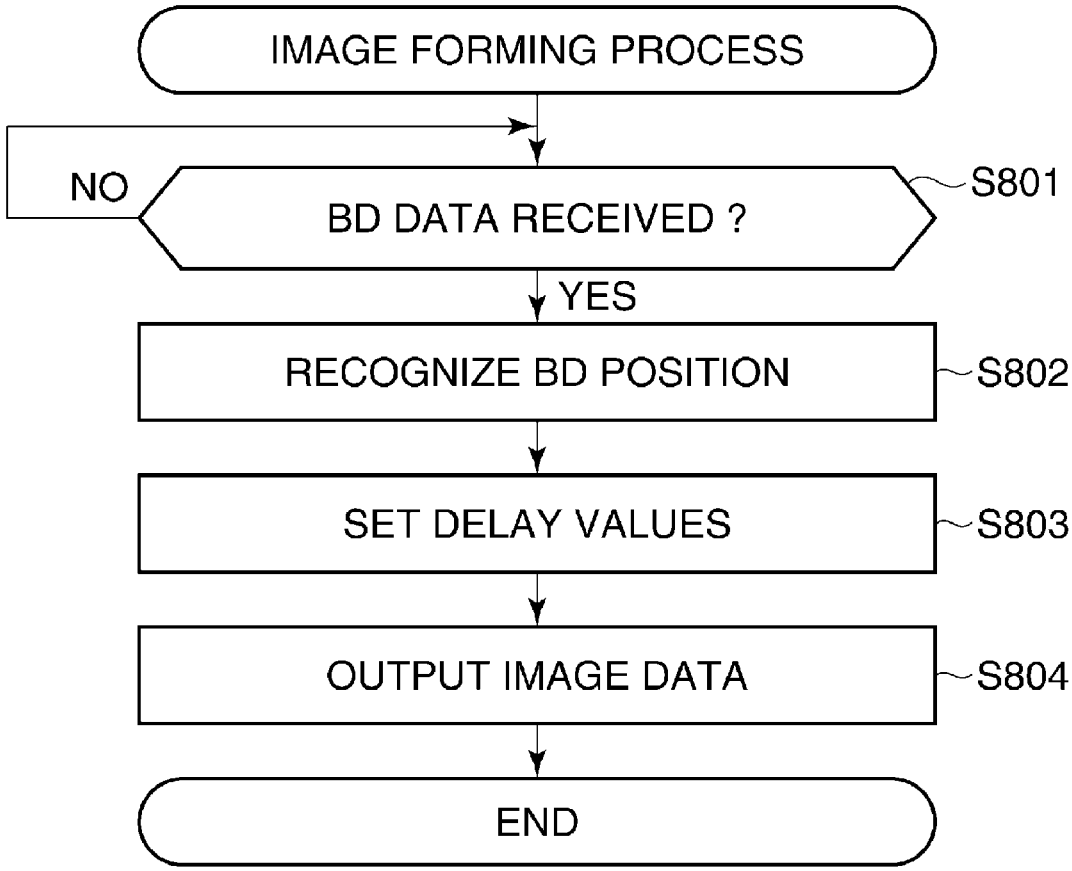
FIG. 8 is a flowchart showing the procedures of an image forming process performed in S608 in FIG. 6.

FIG. 6 shows in flowchart the procedures of laser writing control performed by the laser writing control system shown in FIG. 3. FIGS. 7 and 8 show in flowchart the procedures of a clock phase measurement process performed in S601 in FIG. 6 and the procedures of an image forming process performed in S608 in FIG. 6, respectively.

In S601 in FIG. 6, after electric power is turned on, the phase measurement unit 304 measures a difference between a phase of the clock 433 (first clock) output from the image processing unit 113 to the clock input timing adjuster 331 and a phase of the clock 434 (second clock) output from the phase measurement unit 304 to the timing adjuster 331 as a synchronization clock for measurement data.

To this end, in S701 in FIG. 7, the phase measurement unit 304 inputs measurement data via the clock selector 317 of the clock input timing adjuster 331 and the input selector 332 according to the operation clock 433 for the image processing unit 113. Then, the serial-parallel converter 310 of the phase measurement unit 304 samples measurement data at intervals of 3.7 GHz, and converts the measurement data into 16-bit parallel data, which represents a result of phase measurement of the clock 433. An example of the 16-bit parallel data is shown in FIG. 9A. Since the clock waveform (measurement data) of 231.25 MHz is sampled at intervals of 3.7 GHz in the phase measurement, measurement data just for one period of the clock waveform is observed as an alignment of parallel data consisting of bits 0 to 15.

In S702, the clock selector 317 of the clock input timing adjuster 331 is switched, and the phase measurement unit 304 inputs measurement data via the clock selector 317 and the input selector 322 according to the operation clock 434 for the clock input timing adjuster 331, and converts the measurement data into 16-bit parallel data, which represents a result of phase measurement of the synchronization clock 434 for the measurement data. An example of measurement result is shown in FIG. 9B. Also in the phase measurement of the clock 434, measurement data of one period of the clock waveform is observed as aligned parallel data.

In S703, the phase measurement unit 304 determines a phase difference between the clocks 433, 434 based on the results of waveform measurements for these clocks. The comparison between the parallel data shown in FIGS. 9A and 9B indicates that there is a 6-bit shift between the phase patterns. Thus, the measured phase difference is represented as 6×3.7 GHz period.

Referring to FIG. 6 again, in S602, the phase difference between the clocks 433, 434 measured in S601 is set as a delay value in the clock input timing adjuster 331.

Figure 10:
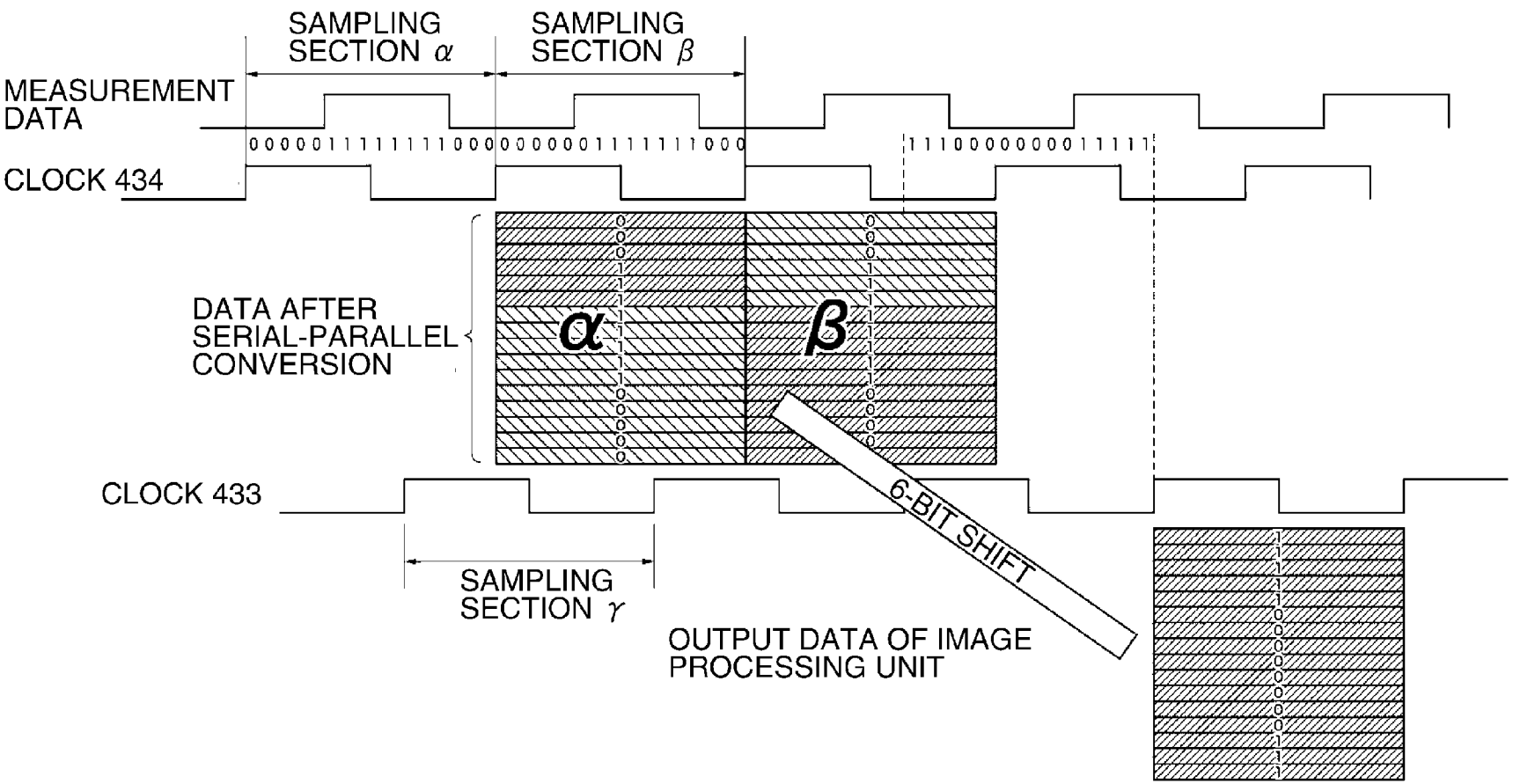
FIG. 10 is a timing chart showing a phase relation between clocks and timings at which measurement data is input to a phase measurement unit of the laser writing control system, measurement data is serial-parallel converted, and data is output to the image processing unit.

FIG. 10 shows an input timing of measurement data to the phase measurement unit 304, a timing of the clock 434, a timing of serial-parallel conversion of measurement data, a timing of the clock 433, and an output timing of measurement data to the image processing unit 113.

As shown in FIG. 10, measurement data is input to the phase measurement unit 304, is subjected to serial-parallel conversion, and is output to the clock input timing adjuster 331 according to the clock 434. For example, measurement data in a sampling section α is output as parallel data α and received by the flip-flop 501 of the delay circuit 316 of the timing adjuster 331. With the next clock, measurement data in a sampling section β is output as parallel data β and received by the flip-flop 501, whereas the parallel data α stored in the flip-flop 501 is transferred to the flip-flop 502.

Next, the parallel data α, β stored in the flip-flops 501, 502 are transferred to and stored as 32-bit data in the flip-flop 503. Then, 16-bit data starting from the sixth bit counted from the first bit is selected from the 32-bit data by the selector 504, and is output via the output-stage flip-flop 505 to the image processing unit 113. Thus, parallel data in a sampling section γ is supplied to the image processing unit 113 and processed as data sampled according to the synchronization clock 434.

In S603 in FIG. 6, by using the same procedures as those in S601 (S701 to S703 in FIG. 7), the phase measurement unit 304 measures a difference between a phase of the clock 433 (first clock) output from the image processing unit 113 to the BD input timing adjuster 315 and a phase of the clock 422 (second clock) output from the BD detection unit 303 as the synchronization clock for BD detection data, while appropriately switching the input selector 332 and the selector 317 of the BD input timing adjuster 315.

In S604, as with S602, the phase difference between the clocks 433, 422 measured in S603 is set as a delay value in the BD input timing adjuster 315.

In S605, by using the same procedures as those in S601 (S701 to S703 in FIG. 7), the phase measurement unit 304 measures a phase difference between the clock 433 (first clock) output from the image processing unit 113 to the image output timing adjuster 324 and the clock 424 (second clock) output from the LD unit 305 as the synchronization clock for receipt of laser drive data, while appropriately switching the input selector 332 and the selector 317 of the image output timing adjuster 324.

In S606, the phase difference between the clocks 433, 424 measured in S605 is set as a delay value in the image output timing adjuster 324.

Figure 11:
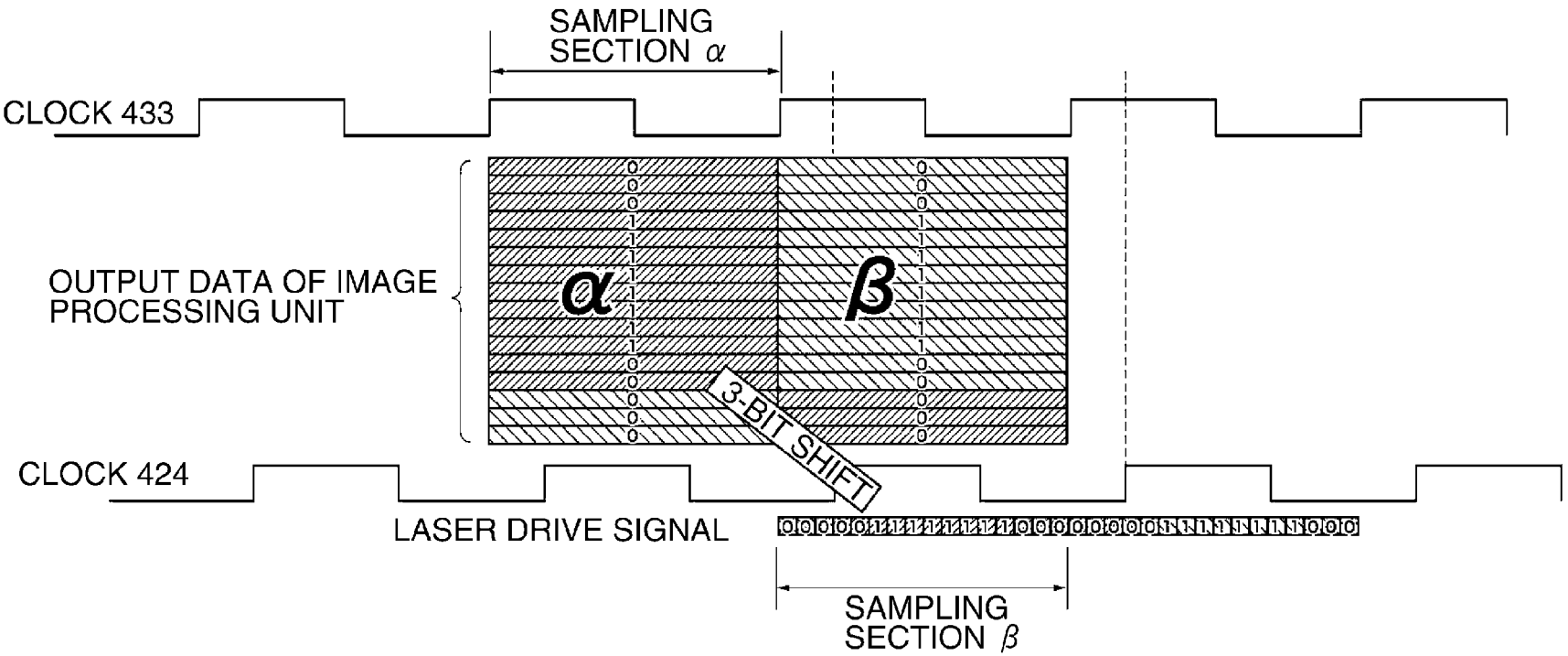
FIG. 11 is a timing chart showing a phase relation between output data of the image processing unit, laser drive signal, and clocks for the laser writing control system.

FIG. 11 shows a data output timing from the image processing unit 113, timings of the clocks 433, 424, and an output timing of data (laser drive signal LD-A) to the LD unit 305. It is assumed here that a 3-bit phase difference is detected in S605.

As shown in FIG. 11, output data of the image processing unit 113 is output to the image output timing adjuster 324 in synchronism with the clock 433. For example, output data α in a sampling section α is received by the flip-flop 501 of the delay circuit 316 of the image output timing adjuster 324. With the next clock, output data β in a sampling section β is output and received by the flip-flop 501, whereas the data α stored in the flip-flop 501 is transferred to the flip-flop 502.

Next, the parallel data α, β stored in the flip-flops 501, 502 are transferred to and stored in the flip-flop 503. Then, 16-bit data starting from the thirteenth bit counted from the first bit is selected by the selector 504 from the aligned 32-bit data stored in the flip-flop 503, and is output via the output-stage flip-flop 505 to the LD unit 305.

Accordingly, the output data of the image processing unit 113 in the sampling section α in FIG. 11 is supplied in the sampling section β to the LD unit 305, as the laser drive signal. In short, the image processing unit 113 outputs data according to the synchronization clock 433.

In S607 in FIG. 6, it is determined whether delay values for all the image output timing adjusters 324 to 327 have been set. If the answer to S607 is NO, the processing in S605 and S606 is repeated while appropriately switching the input selector 332 and the selectors 317 of the image output timing adjusters 325 to 327, thereby setting delay values in the image output timing adjusters 325 to 327. In this manner, the delay values are set to the image output timing adjusters 324 to 327 to adjust output timings of data (laser drive signals), thereby preventing image writing start positions from being shifted due to differences between the phases of operation clock for the LD units 305 to 308.

In S608, the laser writing control system performs an image forming process. In the following, the procedures of the image forming process are described with reference to FIG. 8.

In S801 in FIG. 8, the laser writing control system waits for reception of BD data from the BD input timing adjuster 315. In S802, a BD position is recognized from a BD data bit pattern.

In S803, an additional delay value decided based on the BD position recognized in S802 and the beam spot distance shown in FIG. 2 is added to the delay values (bit shift amounts) set in the delay circuits 316 of the image output timing adjusters 324-327.

In S804, the image processing unit 113 outputs input image data to the image output timing adjusters 324 to 327. The image output timing adjusters 324 to 327 output image data (laser drive signals) to the LD units 305 to 308 at timings corresponding to the delay values set in S803, thereby driving the first to fourth lasers 101A to 101D. As a result, an electrostatic latent image is formed on scanning lines 207 on the photosensitive member 107 shown in FIG. 2, with less positional shift.

As described above, in this embodiment, the BD detection according to a sub-clock signal obtained by multiplying the reference clock 420 by 16 and the laser driving according to a similar sub-clock signal are performed asynchronously, and drive timings of the first to fourth lasers 101A to 101D are adjusted based on differences between the phases of operation clock for respective units of the laser writing control system which are measured by the phase measurement unit 304, whereby the image writing start position can be controlled with high accuracy, without complicating the image forming apparatus (especially, the circuit construction of the laser writing control system).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-178983, filed Jul. 31, 2009, which is hereby incorporated by reference herein in its entirety.

What is claimed is:

1. An image forming apparatus in which light beams emitted from respective ones of light-emitting elements are scanned on an image carrier by a deflection scanning unit to thereby form an electrostatic latent image on the image carrier, comprising:

a sensor configured to detect any of the light beams deflected by the deflection scanning unit and output a detection signal;

an oscillation unit configured to generate a reference clock;

a detection unit configured to convert the detection signal into parallel data according to a first sub-clock obtained by multiplying the reference clock by N, and output the parallel data in synchronism with a clock obtained by dividing the first sub-clock by N;

an image processing unit configured to operate based on the reference clock and output input image data in synchronism with the reference clock;

a laser drive unit configured to receive the image data from said image processing unit in synchronism with a clock obtained by dividing, by M, a second sub-clock obtained by multiplying the reference clock by M and configured to drive the light-emitting elements based on serial data obtained by converting the received image data according to the second sub-clock;

a first adjustment unit configured to adjust a timing of data delivery from said detection unit to said image processing unit based on a difference between a phase of the clock obtained by dividing the first sub-clock by N and a phase of the reference clock supplied to said image processing unit; and a second adjustment unit configured to adjust a timing of data delivery from said image processing unit to said laser drive unit based on a difference between the phase of the reference clock supplied to said image processing unit and a phase of the clock obtained by dividing the second sub-clock by M.

2. The image forming apparatus according to claim 1 wherein said first adjustment unit includes a first storage unit configured to store plural pieces of the parallel data output from said detection unit, and said first adjustment unit adjusts the timing of data delivery from said detection unit to said image processing unit by outputting continuous parallel data selected from the plural pieces of the parallel data stored in said first storage unit, the continuous parallel data starting from a bit position counted from a first bit of the plural pieces of the parallel data and decided according to the difference between the phase of the clock obtained by dividing the first sub-clock by N and the phase of the reference clock supplied to said image processing unit.

3. The image forming apparatus according to claim 1, wherein said second adjustment unit includes a second storage unit configured to store the image data, and said second adjustment unit adjusts the timing of data delivery from said image processing unit to said laser drive unit by outputting continuous parallel data selected from the image data stored in said second storage unit, the continuous parallel data starting from a bit position counted from a first bit of the image data and decided according the difference between the phase of the clock obtained by dividing the second sub-clock by M and the phase of the reference clock supplied to said image processing unit.

4. The image forming apparatus according to claim 1, including:

a measurement unit configured to measure the difference between the phase of the clock obtained by dividing the first sub-clock by N and the phase of the reference clock supplied to said image processing unit and configured to measure the difference between the phase of the clock obtained by dividing the second sub-clock by M and the phase of the reference clock supplied to said image processing unit.

5. The image forming apparatus according to claim 1, wherein said detection unit includes a first sub-clock generator unit that multiplies the reference clock by N to thereby generate the first sub-clock, a first conversion unit that converts the detection signal into the parallel data according to the first sub-clock, and a first clock divider unit that divides the first sub-clock by N.

6. The image forming apparatus according to claim 1, wherein said laser drive unit includes a second sub-clock generator unit that multiplies the reference clock by M to thereby generate the second sub-clock, a second conversion unit that converts the image data into the serial data according to the second sub-clock, and a second clock divider unit that divides the second sub-clock by M.

* * * * *